United States Patent [19]

Viscovich et al.

[11] 4,272,962

[45] Jun. 16, 1981

[54] PRESSURE CONTROLLER FOR DUAL PURPOSE STEAM TURBINE POWER PLANT

[75] Inventors: Paul W. Viscovich, Swedesboro, N.J.; Moti T. Khemlani, West Chester, Pa.

[73] Assignee: Westinghouse Electric Corp., Pittsburgh, Pa.

[21] Appl. No.: 968,951

[22] Filed: Dec. 13, 1978

[51] Int. Cl.[3] ..... F01K 17/00

[52] U.S. Cl. ..... 60/648; 60/661; 60/686; 165/39

[58] Field of Search ..... 60/648, 661, 677, 686, 60/689, 692; 165/39, 112, 31, 34

[56] References Cited

U.S. PATENT DOCUMENTS

| | | | |
|---|---|---|---|
| 1,982,060 | 11/1934 | McCallum et al. | 60/661 |
| 2,104,333 | 1/1938 | Rosenblad | 165/34 X |
| 3,412,558 | 11/1968 | Starmer | 60/648 X |
| 3,703,809 | 11/1972 | Cassidy | 60/661 X |

*Primary Examiner*—Allen M. Ostrager
*Assistant Examiner*—Stephen F. Husar
*Attorney, Agent, or Firm*—W. E. Zitelli

[57] ABSTRACT

At least one heat exchanger section including a conventional heat exchanger is disposed in a dual purpose steam turbine power plant to utilize steam extracted from the steam turbine to one section of the heat exchanger for the purposes of heating process fluid of an industrial process which is conducted through another section of the heat exchanger. The heat exchanger section disclosed herein is comprised of apparatus for controlling the pressure of the extracted turbine steam conducted through the one section of the heat exchanger by regulating the temperature of the industrial fluid supplied to the other section of the heat exchanger. More specifically, the heat exchanger section includes at least one conduit path for returning heated process fluid from an output end to an input end of the heat exchanger section to mix with the process fluid supplied at the input end. A flow control valve is disposed in the conduit path for regulating the flow of returned fluid to the input end. A pressure controller, comprising: a means for generating a signal representative of the pressure of the extracted turbine steam conducted through the heat exchanger; means for generating an error signal between a desired pressure set point signal and the pressure representative signal; and means for controlling the flow control valve as a function of the error signal to converge the error signal to substantially zero, maintains the pressure of the extracted steam conducted through the heat exchanger substantially at its desired pressure set point.

16 Claims, 2 Drawing Figures

PRESSURE CONTROLLER FOR DUAL PURPOSE STEAM TURBINE POWER PLANT

BACKGROUND OF THE INVENTION

The present invention relates broadly to dual purpose steam turbine power plants which cogenerate energy for electrical consumption and industrial process heating needs, wherein an industrial process may extract steam from the turbine for use in one or more heat exchanger sections employed thereby, and more particularly, to a heat exchanger section operative to control the pressure of the extracted turbine steam substantially at a predetermined pressure set point value.

In most steam turbine power plants proposed to have a dual purpose, after the steam has been conducted through the steam turbine wherein energy is extracted to mechanically power the steam turbine to drive a generator coupled thereto to produce electrical energy at a desired power, the exhausted steam or portion thereof may be provided to one or more heat exchangers of an industrial process, like desalinization, for example, for the purposes of extracting heat energy therefrom. As a result of this dual purpose configuration, the safety requirements and operational needs of both the electrical power plant and industrial process must be considered. One parameter of prime importance is that of the steam turbine exhaust pressure or more commonly termed the turbine back pressure. It is well known that in a conventional single purpose steam turbine plant, if this back pressure is allowed to exceed some predetermined limiting value, it may result in mechanical overloading of the last stages of the low pressure turbine element especially those stages in close proximity to the turbine steam exhaust. As a safety requirement in most of these single purpose plants, either the turbine is tripped as a result of a back pressure excursion beyond the preset limit or the back pressure is limited to remain below the preset limit by some control method exemplified by that described in the U.S. Pat. No. 4,004,424 issued to Maddagiri on Jan. 25, 1977. It is also well known that in order for an industrial process, which may be interfaced to a steam turbine power plant, to efficiently utilize the extracted low pressure steam provided thereto from the steam turbine exhaust, for example, the pressure of this extracted steam, or in effect, temperature thereof, should be at a value to insure the economic commercial feasibility of the industrial process; otherwise, the dual purpose of the power plant would not be warranted.

Therefore, it is evident that an optimum process heat exchanger pressure should be derived to satisfy both the safety requirements of the steam turbine and the efficiency requirements for commercially feasible operation of the industrial process interfaced therewith. And accordingly, in order to preserve the availability of the electrical power generation of the steam turbine-generator and ensure commercially efficient operation of the industrial process as related to utilization of the extracted steam from the steam turbine, it is of paramount importance to continuously maintain the steam pressure of the heat exchanger at the aforementioned derived optimum value during the concurrent dual operation of the electrical generation and the industrial process. It is a primary object of the present invention as described hereinbelow to accomplish this pressure control pertaining to the dual purpose operability of the steam turbine power plant.

SUMMARY OF THE INVENTION

At least one heat exchanger section including a conventional heat exchanger is disposed in a dual purpose steam turbine power plant to utilize steam extracted from the steam turbine to one section of the heat exchanger for the purposes of heating process fluid of an industrial process which is conducted through another section of the heat exchanger. In accordance with the broad principles of the present invention, the heat exchanger section is comprised of apparatus for controlling the pressure of the extracted turbine steam conducted through the one section of the heat exchanger by regulating a heat transfer characteristic, preferably temperature, of the industrial fluid supplied to the other section of the heat exchanger, the apparatus comprising: a means for generating a signal representative of the pressure of the extracted steam conducted through the heat exchanger; a first means for generating an error signal representative of the difference between the generated pressure representative signal and a desired pressure set point signal; and a second means governed by said error signal to regulate a heat transfer characteristic, preferably temperature, of the process fluid as conducted through the heat exchanger for influencing the pressure of the extracted steam in the heat exchanger. In one aspect of the present invention, the regulation of the heat transfer characteristic by the second means converges the governing error to substantially zero, whereby the pressure of the extracted steam conducted through the heat exchanger is maintained substantially at its corresponding desired pressure set point.

More specifically, the heat exchanger section includes an input end into which the process fluid is supplied; an output end to exit the process fluid at elevated temperatures; at least one conduit path for returning heated process fluid from the output end to the input end of the heat exchanger section to mix with the process fluid supplied at the input end; means, preferably a flow control valve, disposed in the conduit path for regulating the flow of returned fluid to the input end; means, preferably a circulation pump, for causing said mixed process fluid to flow through the heat exchanger; and a controller governed by the error signal to control the regulation of returned fluid flow by the flow regulating means which in the preferred embodiment is accomplished by controlling the positioned opening of a flow control valve disposed in the conduit path. Preferably, turbine steam is extracted from an exhaust portion of the steam turbine; in which case, the pressure of the steam conducted through the heat exchanger is proportional to the back pressure of the steam turbine.

DESCRIPTION OF THE PREFERRED EMBODIMENT

Figure 1:
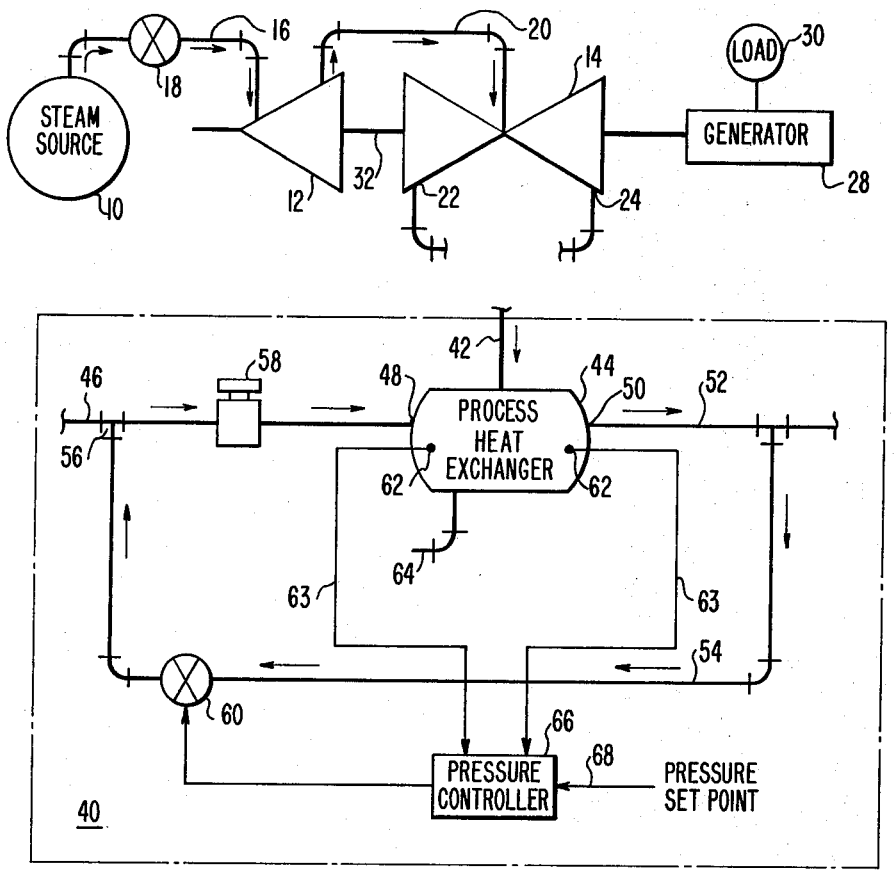
FIG. 1 is a schematic diagram depicting a dual purpose steam turbine power plant suitable for embodying the broad principles of the present invention.

Referring to FIG. 1, steam is provided from a steam source 10 to a conventional steam turbine which may be comprised of a high pressure turbine element 12 and at least one lower pressure turbine element 14. Steam is generated within the steam source 10 by any of the well known systems including a fossil fueled boiler or a nuclear steam supply system (NSSS). Steam from the steam source 10 is conducted to the high pressure turbine element 12 over piping 16. Normally disposed in piping 16 is a configuration of steam admission valves 18 for regulating the flow of steam through the steam turbine. Generally, steam exhausting from the high pressure element 12 is conducted over crossover piping 20 to the input of the lower pressure turbine elements 14. Steam may be exhausted from the lower pressure turbine elements at exhaust points 22 and 24, for example, and possibly from other known extraction points which are not shown in the Figure. An electrical generator 28 is normally mechanically coupled to the steam turbine by a turbine shaft 32 and driven by rotation of the steam turbine shaft 32 to generate electrical energy to a load 30 at some desired electrical power.

In operation, the steam conducted through the high pressure turbine element 12 and lower pressure turbine element 14 provides a torque to rotate the turbine shaft 32 to drive the generator 28 which supplies power to the load 30. Once the generator 28 is coupled to the load 30, the amount of electrical power produced by the generator 28 is proportional to the steam admitted through the steam turbine as regulated by the steam admission valves 18.

As part of the dual purpose steam turbine power plant, steam may be extracted from the steam turbine at at least one point, preferably the exhaust piping shown at 22 or 24, and supplied to one or more heat exchanger sections 40 included as part of an industrial process. In one case, the industrial process may be a desalinization process, for example, wherein the heat exchanger section 40 may constitute at least one stage of heating in the desalinization process. Typically, the extracted steam supplied at 42 may be conducted through one section of a conventional process heat exchanger 44 and may exit through condensate piping 64. Process fluid is supplied to the process heat exchanger 44 over piping 46 to an input end 48. The process fluid, which in the case of desalinization heating may be comprised of a brine solution, for example, is conducted through another section of the process heat exchanger 44 which is commonly physically isolated from the one section which contains the extracted steam. Heat energy is transferred from the extracted steam in the one section of the heat exchanger 44 to the process fluid of brine solution, for example, conducted through the other section of the heat exchanger 44. The heated process fluid exits the heat exchanger 44 at an output end 50 over piping 52. A conduit 54, appropriately sized, is coupled between the output piping 52 and the input piping 46 to permit heated process fluid exited by the heat exchanger 44 at the output 50 to be returned to the input piping 46 and mixed with the supplied process fluid at a mixing point 56. In the input piping 46, disposed between the mixing point 56 and the input of the heat exchanger 44 is a conventional circulation pump 58. The circulation pump 58 pumps the mixture of the process supply fluid and the returned fluid through the other section of the heat exchanger. Due to this pumping action, in most cases, the pressure at the exit point 50 of the heat exchanger 44 will be greater than the pressure of the fluid at the mixing point 56. At least one conventional fluid control valve 60 may be disposed in the conduit 54 for regulating the flow of the return heated process fluid. The difference in pressure across the valve 60 hydraulically forces the fluid to flow through the valve 60 at a rate which is proportional to the flow area of the valve 60. Generally, the flow area of the valve is commensurate with the positional opening of the valve 60.

While only one path comprising input piping 46, output piping 52 and circulation pump 58 is shown in FIG. 1 to conduct process fluid through the heat exchanger 44, generally, as is well known in the pertinent art, there may exist a multiple of these conduction paths (not shown) for any conventional heat exchanger 44. Accordingly, the embodiment exemplified in FIG. 1, in which only one process fluid return path 54 and fluid regulator 60 disposed therein is illustrated, may be extended to include the arrangement of multiple process fluid conduction paths through the heat exchanger 44 with each path preferably having its own return path 54 and fluid regulation mechanization 60 to return process to its corresponding input piping of the heat exchanger section 40 without deviating from the broad principles of the present invention. In this example, the input and output ends of the heat exchanger section 40 and the another section of the heat exchanger 44 are made up of the multiple conduction paths of the process fluid.

Disposed within the one section of the process heat exchanger 44 may be a plurality of conventional pressure transducers of the highly responsive type 62. Each of these pressure transducers 62 generates signals 63 representative of the pressure of the extracted turbine steam within the one section of the heat exchanger 44. The design of the process heat exchanger 44, the heat transfer operation which takes place therein and the placement of the pressure transducer 62 within the one section of the heat exchanger 44 are not described in detail in the instant specification because they are considered conventional and well known to one skilled in the pertinent art and in no way form in detail any part of the present invention which relates, in principle, partly to the monitoring of the extracted steam pressure within the chambers of the one section of the heat exchanger. The steam pressure representative signals 63 are provided to a pressure controller shown at 66. A pressure set point signal 68 which may be representative of the derived optimum extracted steam pressure desired to be maintained in the heat exchanger 44 as described in the Background Section provided hereinabove is additionally provided to the pressure controller 66. Based on a function of the input signals 63 and 68, the pressure controller 66 governs the positional opening of the flow control valve 60 which in turn regulates the flow of returned fluid through the conduit 54. The return fluid is ultimately mixed with the supply fluid at point 56.

Figure 2:
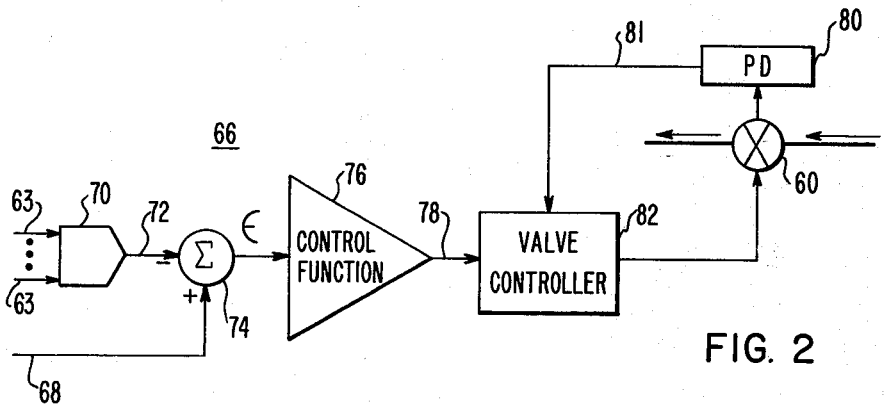
FIG. 2 is a schematic block diagram of a pressure controller suitable for embodiment in the power plant depicted in FIG. 1.

A representative pressure controller 66 suitable for use in the embodiment of FIG. 1 is shown in FIG. 2. The plurality of pressure measurement representative signals 63 may be provided to inputs of a selection and conversion type function 70. In the case in which the plurality of pressure measurements are implemented for redundancy purposes, one of the signals 63 may be selected at 72 to be representative of the extracted steam pressure in the one section of the heat exchanger 44. In another case in which the pressure measurements may be taken at various points in the one section of the heat exchanger 44, a weighted average of pressure distribution may be desired and computed by function 70; in which case, the signal provided over line 72 may be representative of the weighted average. In either case, the signal 72 is provided to the negative input of a summing function 74 and the desired pressure set point signal 68 is provided to the positive input of the summing function 74. An error signal $\epsilon$ is produced by the summing function 74 and provided to a control function 76. This control function 76 may be any one of the well known conventional type controllers like a proportional plus integral or a straight proportional or even a more sophisticated stability oriented dynamic controller, all of which are generally well known and neither of which, in detail, form any part of the present invention. The control function 76 outputs a control signal 78 which may be representative of a flow demand request for the flow control valve 60. In some more sophisticated systems, a position detection device 80 such as an LVDT, for example, may be coupled to the flow control valve 60 to establish the actual position thereof and provide a signal to a known servo valve controller 82 as an indication of that position. Generally, as is well known in the servo control art, the valve controller 82 governs the positional opening of the flow control valve 60 in accordance with a function based on an error between the position indicative feedback signal 81 and the demand signal 78.

Assuming a typical operation of the heat exchanger section 40 exemplified by only one process fluid conduction path, extracted steam 42 is provided to the heat exchanger section 40 generally from the exhaust points 22 and 24 or extraction points (not shown) of the steam turbine, or from both, at a pressure normally commensurate with the load demand on the steam turbine. The extracted steam 42 is continuously conducted through the one section (not shown) of the heat exchanger 44 and exited through the condensate piping 64. Concurrently, process fluid is provided through the piping 46 and mixed with the return heated process fluid at the mixing point 56. The process fluid mixture is pumped through the other section (not shown) of the heat exchanger 44 by the circulation pump 58. A well known heat transfer operation takes place in the heat exchanger 44 wherein heat energy is transferred from the extracted steam to the process fluid mixture. The heated process fluid exiting the heat exchanger 44 at 50 is conducted through the piping 52 to other stages of the industrial process. A portion of this heated process fluid is returned to the mixing point 56 through the conduit 54 as flow regulated by the valve 60.

The extracted steam pressure is monitored in the one section of the heat exchanger 44 utilizing the conventional pressure transducers 62 which supply pressure representative signals 63 to the pressure controller 66. The pressure controller 66 derives a pressure representative signal 72 from the signals 63 using well known methods. A pressure error may exist between the desired pressure set point signal 68 and the selected representative pressure measurement signal 72. The pressure controller 66 governs the positional opening of the flow control valve 60 in accordance with the pressure error signal $\epsilon$ to alter the flow rate of the return process fluid. Consequently, a different mixture may be yielded at the mixing point 56 rendering a different temperature of the mixed process fluid as pumped through the heat exchanger 44 by the circulation pump 58. The difference in temperature of the process fluid conducted in the other section of the heat exchanger 44 as rendered by the change in flow rate of the return process fluid changes the heat transfer characteristics of the fluid mixture which affects the heat transfer operation being carried out in the heat exchanger 44. In accordance with well known heat transfer phenomena, the change in heat transfer characteristics of the process fluid mixture, such as its temperature as in the preferred case, ultimately influences the pressure of the extracted steam conducted through the one section of the heat exchanger 44. If the temperature variation of the process fluid mixture as conducted through the other section of the heat exchanger 44 is in an appropriate sense, it causes the pressure of the extracted steam being conducted through the one section of the heat exchanger 44 to converge to the desired pressure set point value. As the pressure error signal $\epsilon$ derived in the pressure controller 66 converges substantially to zero, the return fluid flow as regulated by the valve 60, will gradually approach a constant state.

In this manner, should the heat transfer process being carried out in the heat exchanger 44 be affected by any one of a number of different conditions, such as a change in the temperature of the supply process fluid, a change of the pumping rate of the recirculation pump 58, or a change in the desired load demand on the steam turbine, for example, to an extent which will disturb the pressure of the extracted steam 42 as conducted through the process heat exchanger 44, then the pressure controller 66 may detect this pressure differential $\epsilon$ from the desired pressure set point value 68 and alter the return fluid flow through conduit 54 by governing the positional opening of the flow control valve 60. Ultimately, the mixed process fluid will regulate the heat transfer characteristics of the process fluid mixture in the heat exchanger 44 to produce a pressure of the extracted steam consistent with that desired from the pressure set point 68.

It is understood that while only one conduction path is exhibited in FIG. 1 to illustrate a process fluid conduction through the heat exchanger and heated fluid return to the supply input, a plurality of conduction paths may likewise be embodied to perform this function wherein each path may additionally include a conduit return path and at least one flow control valve disposed therein; in which case, the pressure controller 66 controls each of the valves. It is further understood that while in most cases the pressure at the exit 50 of the heat exchanger 44 is considered to be higher than the pressure at the supply point 46 which allows a flow control valve 60 to be embodied in the conduit for control of the return fluid flow, there are conditions which may exist in which the pressure at the exit end 50 of the heat exchanger 44 may not be at a greater pressure than the supply input point 46, in which case, the flow control valve may be replaced with a device for pumping the fluid through the conduit 54 like a circulation pump, for example. Accordingly, the pressure controller 66 then may govern the pumping device to alter the return fluid flow in accordance with the pressure differential as described hereinabove. It is still further understood that possibly for economic and performance reasons other modifications and additions to the preferred embodiment described in connection with FIGS. 1 and 2 may be conceived to supply fluid to the process heat exchanger and provide conduit return paths to mixing points in the supply fluid lines; however none of these modifications or additions to the structure should be considered as beyond the broad principles of applicant's invention. Rather, applicant's invention should not be limited to any one embodiment such as simply shown in FIGS. 1 and 2, but should be construed in accordance with the breadth and broad scope of the claims to follow.

We claim:

1. A heat exchanger for use in a dual purpose steam turbine power plant wherein steam extracted from said steam turbine power plant is supplied through one section of said heat exchanger and a process fluid is conducted through another section of said exchanger, which is physically isolated from said one section, said heat energy of said extracted steam being transferred to said process fluid within said heat exchanger to elevate the temperature of said process fluid, said heat exchanger comprising:

an input end into which said process fluid is supplied to said another section;

an output end to exit process fluid at elevated temperatures from said another section;

means for returning heated process fluid to said input end to be mixed with the process fluid supplied to said another section;

means for causing said mixed process fluid to flow through said another section;

means for regulating the flow of process fluid returned back to said input end from said output end;

means for generating a signal representative of the pressure of said extracted steam in said one section; and means governed by said steam pressure representative signal and a desired pressure set point signal to control said flow regulating means to influence the pressure of the extracted steam as conducted through said one section.

2. A heat exchanger in accordance with claim 1 wherein the controlling means controls the flow regulating means to maintain said steam pressure representative signal substantially at the desired pressure set point, whereby the pressure of the extracted steam conducted through the heat exchanger is maintained substantially at the desired pressure set point.

3. A heat exchanger in accordance with claim 1 wherein the process fluid returning means comprises at least one conduit coupled between the output end and the input end; and wherein the return fluid flow regulating means comprises at least one flow control valve disposed in said conduit, said fluid return flow being regulated by controlling of the positional opening of said flow control valve.

4. A heat exchanger in accordance with claim 1 wherein said means for causing the mixed process fluid to flow through the another section comprises a circulation pump.

5. A heat exchanger in accordance with claim 4 wherein said circulation pump is disposed at the input end of the heat exchanger; and wherein the process fluid returning means comprises at least one conduit coupling the output end to the low pressure side of the circulation pump to permit mixing of the returned heated fluid with the supplied fluid prior to being pumped through the another section.

6. A heat exchanger in accordance with claim 1 wherein the pressure signal generating means comprises at least one pressure transducer disposed in said one section for measuring the pressure of the extracted steam conducted therethrough.

7. A heat exchanger in accordance with claim 6 wherein the turbine steam is extracted from the exhaust portion of the steam turbine; and wherein the pressure measured in the one section is proportional to the back pressure of the steam turbine.

8. A heat exchanger in accordance with claim 1 wherein the process fluid comprises a brine solution; and wherein said heat exchanger comprises at least one stage of heating in a desalinization process.

9. In a dual purpose steam turbine power plant including a source of steam; a steam turbine rotated by conducting steam from said source therethrough; and at least one heat exchanger section including a heat exchanger operative to transfer heat energy between at least two physically isolated fluids conducted therethrough, said one fluid being steam extracted from said steam turbine and said other fluid being fluid to be heated as part of an industrial process, said heat exchanger section having an input end through which said process fluid is supplied and an output end to which said process fluid at an elevated temperature exits, apparatus for controlling the pressure of the extracted steam conducted through said heat exchanger section comprising:

means for generating a signal representative of the pressure of the extracted steam conducted through said heat exchanger;

first means for generating an error signal representative of the difference between said generated pressure representative signal and a desired pressure set point signal; and second means governed by said error signal to regulate the temperature of said process fluid conducted through said heat exchanger for influencing the pressure of the extracted steam in said heat exchanger.

10. A pressure controller in accordance with claim 9 wherein the regulation of the temperature by the second means converges the governing error signal to substantially zero, whereby the pressure of the extracted steam conducted through the heat exchanger is maintained substantially at its corresponding desired pressure set point.

11. A pressure controller in accordance with claim 9 wherein the second means includes:

at least one conduit path for returning heated process fluid from the output end to the input end of the heat exchanger section to mix with the process fluid supplied at the input end;

means disposed in said conduit path for regulating the flow of returned fluid to the input end of the heat exchanger section;

means for causing said mixed process fluid flow to flow through the heat exchanger; and means governed by the error signal to control the regulation of returned fluid flow by the flow regulating means.

12. A pressure controller in accordance with claim 11 wherein the means for causing the mixed process fluid to flow through the heat exchanger comprises a circulation pump.

13. A pressure controller in accordance with claim 11 wherein the flow regulating means is at least one flow control valve, said fluid return flow being regulated by the control of the positional opening of said fluid flow control valve by the controlling means.

14. A pressure controller in accordance with claim 9 wherein the pressure signal generating means comprises at least one pressure transducer disposed in the heat exchanger for measuring the pressure of the extracted steam conducted therethrough.

15. A pressure controller in accordance with claim 9 wherein turbine steam is extracted from an exhaust portion of the steam turbine; and wherein the pressure representative signal is proportional to the back pressure of the steam turbine.

16. The dual purpose steam turbine power plant in accordance with claim 9 wherein the industrial process is one of desalinization; wherein the heat exchanger section constitutes at least one stage of desalinization heating; and wherein a process fluid comprises a brine solution.

* * * * *